United States Patent [19]

Matsuo

[11] 3,941,372

[45] Mar. 2, 1976

[54] FEEDING APPARATUS FOR CORRUGATED CARDBOARD SHEETS

[76] Inventor: Masaharu Matsuo, No. 3-17, 3-Chome, Higashi Komagata, Sumida, Tokyo, Japan

[22] Filed: Apr. 14, 1975

[21] Appl. No.: 567,884

[30] Foreign Application Priority Data

May 4, 1974 Japan ..... 49-49268

[52] U.S. Cl. ..... 271/95; 271/96; 271/99; 271/104

[51] Int. Cl.[2] ..... B65H 3/12

[58] Field of Search ..... 271/94, 95, 96, 35, 12, 271/99, 104, 108, 165, 136, 118, 276; 214/8.5 D

[56] References Cited

UNITED STATES PATENTS

| | | | |
|---|---|---|---|
| 3,051,477 | 8/1962 | Panlic | 271/136 X |
| 3,193,282 | 7/1965 | Stewart | 271/95 X |

*Primary Examiner*—John J. Love
*Assistant Examiner*—Bruce H. Stoner, Jr.
*Attorney, Agent, or Firm*—Hans Berman

[57] ABSTRACT

Corrugated cardboard sheets are drawn individually from the bottom of a stack by two perforated, continuous belts downwardly bounding a receptacle space which is bounded in a forward direction by a gate. The front part of each belt under the receptacle space travels over a suction box while the rear part may be shifted between an operative position in which the front and rear parts are longitudinally aligned and an idling position in which the rear part is offset from the operative position downward and outward of the receptacle space. The suction box and the shifting mechanism for the rear part of the belt under the receptacle space are synchronously controlled in such a manner that the rear part of the belt is in the operative position while the suction box is being evacuated for maximum traction effect of the belt on the lowermost sheet in the stack, and the rear part is dropped into the idling position while the suction box is vented to the ambient atmosphere so that the belts slip under the stack, and successively fed corrugated sheets are spaced from each other and do not overlap.

8 Claims, 9 Drawing Figures

FEEDING APPARATUS FOR CORRUGATED CARDBOARD SHEETS

This invention relates to apparatus for feeding sheet material, and particularly to apparatus for feeding corrugated cardboard sheets.

Corrugated cardboard is the most common material of construction for relatively light packing boxes, and such boxes are made on automatic equipment to which blanks of cardboard must be fed in uniform sequence. Corrugated cardboard, while very strong in relation to its weight, does not offer much resistance to concentrated stresses. The several layers of thin paper stock which jointly constitute the corrugated cardboard are fragile. It is difficult to convey corrugated cardboard blanks between pressure rollers without damage being caused by the rollers. It is almost as difficult to convey such blanks by means of pushers acting on one of the narrow edges of the blank. Moreover, the material has little bending strength transversely to the corrugations.

Mechanical feeding apparatus presently available to the manufacturer of corrugated cardboard boxes leaves much to be desired, and pneumatic devices which grip the blanks by means of suction cups or the like have not found wide acceptance because the corrugated cardboard carries much paper dust which tends to clog the vacuum lines on feeding apparatus of the known suction type.

One of the primary objects of this invention is the provision of improved sheet feeding apparatus of the suction type.

With this object and others in view, as will hereinafter become apparent, the invention provides a sheet feeding apparatus in which a continuous, perforated, elongated belt is guided on a support in a closed, longitudinal loop. A gate arrangement mounted on the support bounds a receptacle space in a forward, horizontal direction when the apparatus is in its normal working position, the space being adapted to hold a stack of sheets. The belt, in a portion of its loop, bounds the receptacle space transversely to the first-mentioned direction for supporting the stack and has a front part adjacent the gate arrangement and a rear part remote from the gate arrangement.

The guiding mechanism for the belt includes a shifting device which can shift the rear part of the belt back and forth between an operative position in which the rear part is aligned with the front part in the direction of belt elongation, and an idling position spaced from the operative position outward of the receptacle space, and normally downward. The machine drive continuously moves the belt in the loop in a direction from the rear part toward the front part. Air may be drawn from the receptacle space through the perforations in the front part of the belt by a suction device.

An automatic control mechanism is operatively connected to the suction device and to the shifting device for operating the same in timed sequence, said suction device being actuated by the control mechanism when the rear part of the belt under the receptacle space is in its operative position, and the perforations in the front part of the belt are vented to the atmosphere when the rear part is in its idling position.

Other features, additional objects, and many of the attendant advantages of this invention will readily be appreciated as the same becomes better understood by reference to the following detailed description of a preferred embodiment when considered in connection with the appended drawing in which.

Figure 1:
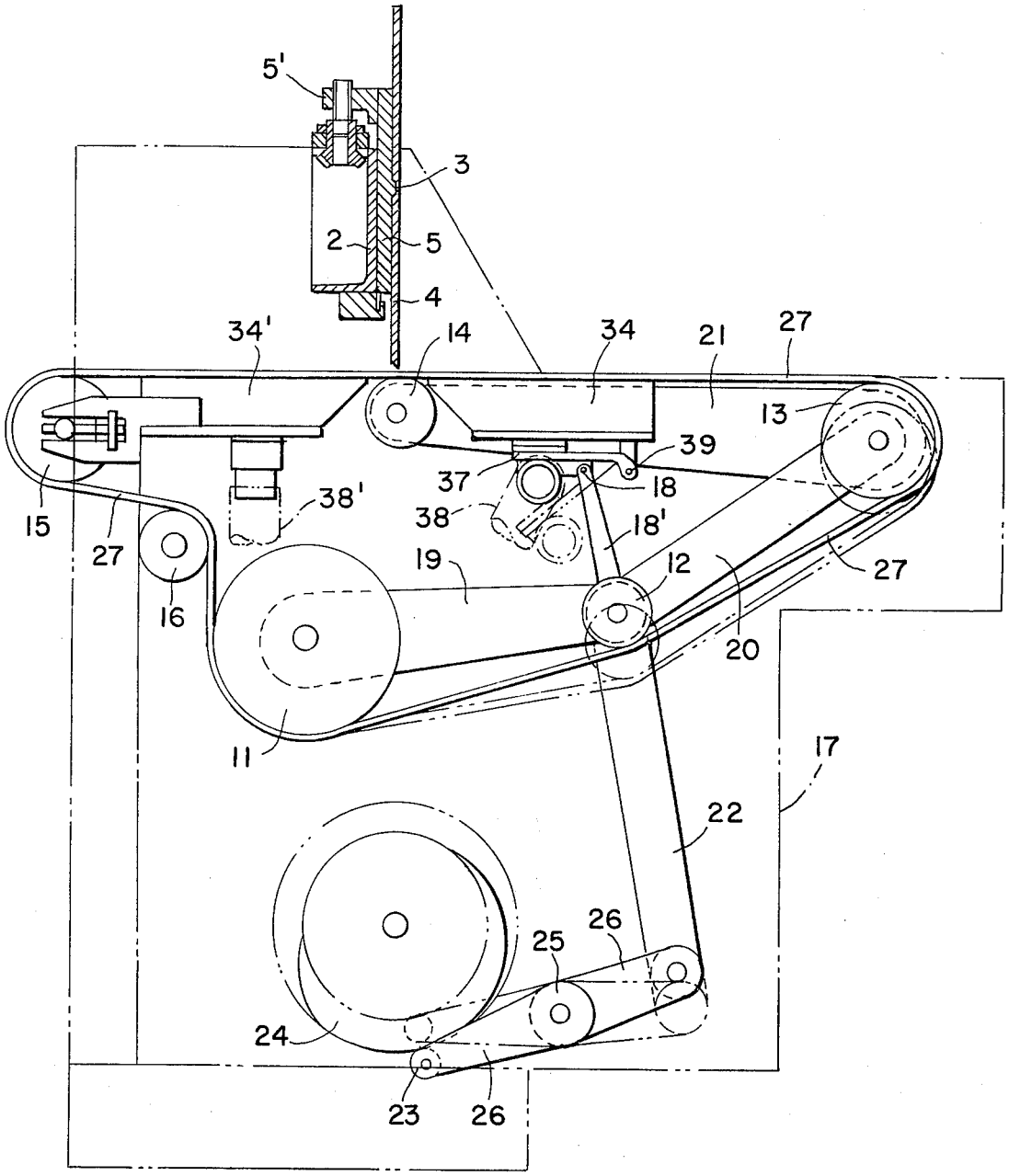
FIG. 1 shows a sheet feeding machine of the invention in partly sectional, fragmentary side elevation.

Referring now to the drawing in detail, and initially to FIG. 1, there is seen a sheet-feeding machine whose operating elements are supported on a casing 17. A continuous, perforated belt 27 travels in an essentially horizontal plane from a first guide pulley 13 over a first suction box 34, another guide pulley 14, a second suction box 34', and a third guide pulley 15, thereafter back to the first guide pulley 13 on a lower level over a tension pulley 16, a driven pulley 11, and a fourth guide pulley 12. The axes of rotation of the pulleys 11 and 14 are fixed relative to the casing 17, and that of the pulley 15 may be shifted horizontally and fixed in a desired position to adjust for the length of the belt 27. The axis of the pulley 16 is shifted by a non-illustrated weight to keep the belt 27 taut in a conventional manner.

A three-member linkage consisting of arms 19, 20, 21 hingedly connected by the shafts of the pulleys 12, 13 secures the last-mentioned shafts to those of the pulleys 11, 14. The linkage, together with the pulleys 12, 13 and the portion of the belt 27 trained over the pulleys 11 to 14, is oscillated between the positions shown in FIG. 1 in fully drawn and chain-dotted lines respectively, the shafts of the pulleys 12, 13 being guided in arcuate slots of the casing 17. A radial control cam 24 is continuously rotated in the casing 17 by a shaft 25 connected to the machine drive which also rotates the pulley 11. One arm of a rocker 26 journaled in the casing 17 carries a cam follower pulley 23 which travels over the face of the cam 24, while the other rocker arm is pivotally fastened to one end of a connecting rod 22 whose other end is fastened to the shaft of the fourth guide pulley 12.

A coupling flap 37 is secured to the underside of the suction box 34 by a pivot pin 39 and is connected to a non-illustrated vacuum pump by a flexible hose 38. When the rotating cam 24 oscillates the linkage 19, 20, 21, the flap 37 is swung between a fully drawn actuated position and a venting position shown in chain-dotted lines by a link 18' hingedly fastened to the flap 37 by a pin 18 and similarly to the shaft of the pulley 12.

Figure 2:
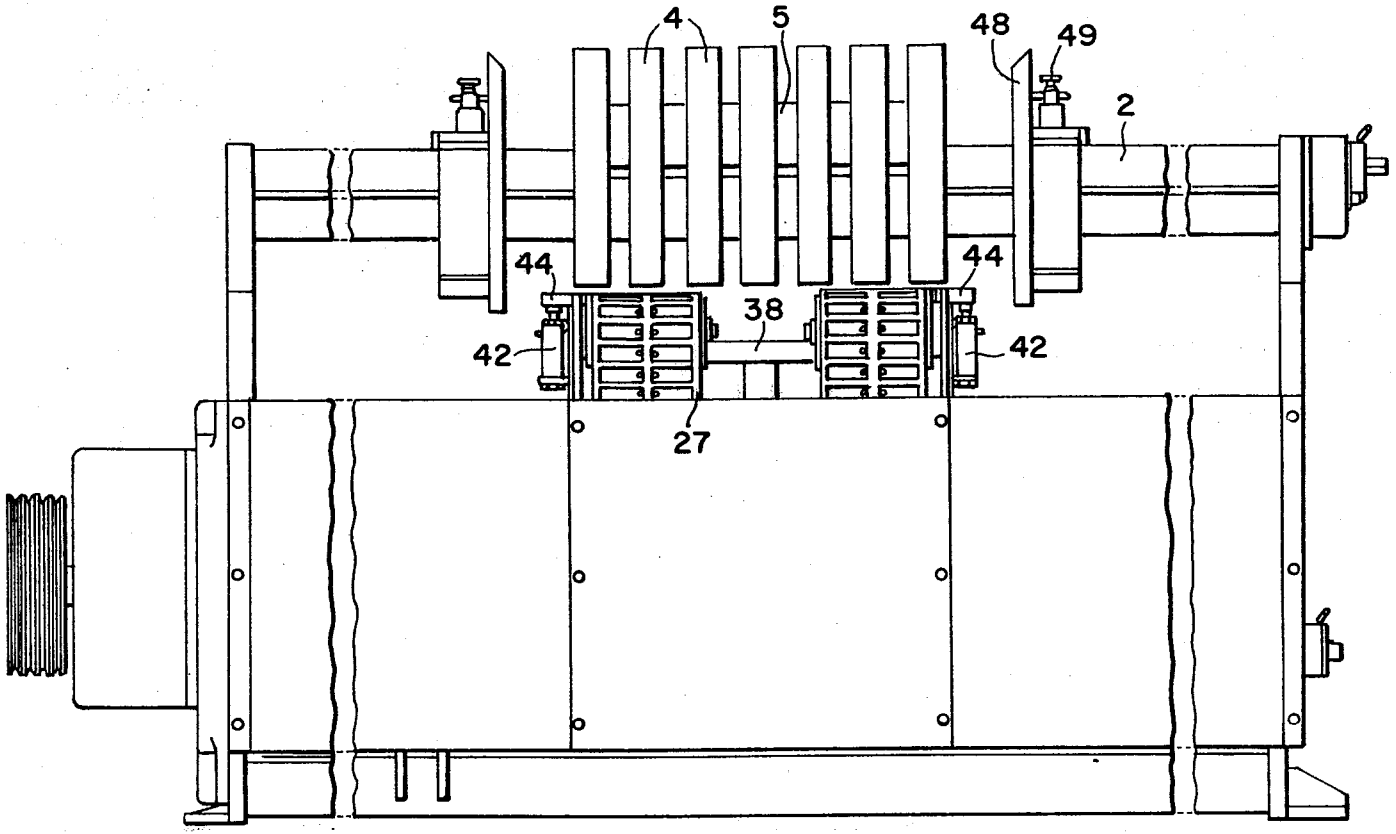
FIG. 2 shows the machine of FIG. 1 in rear elevation.
Figure 3:
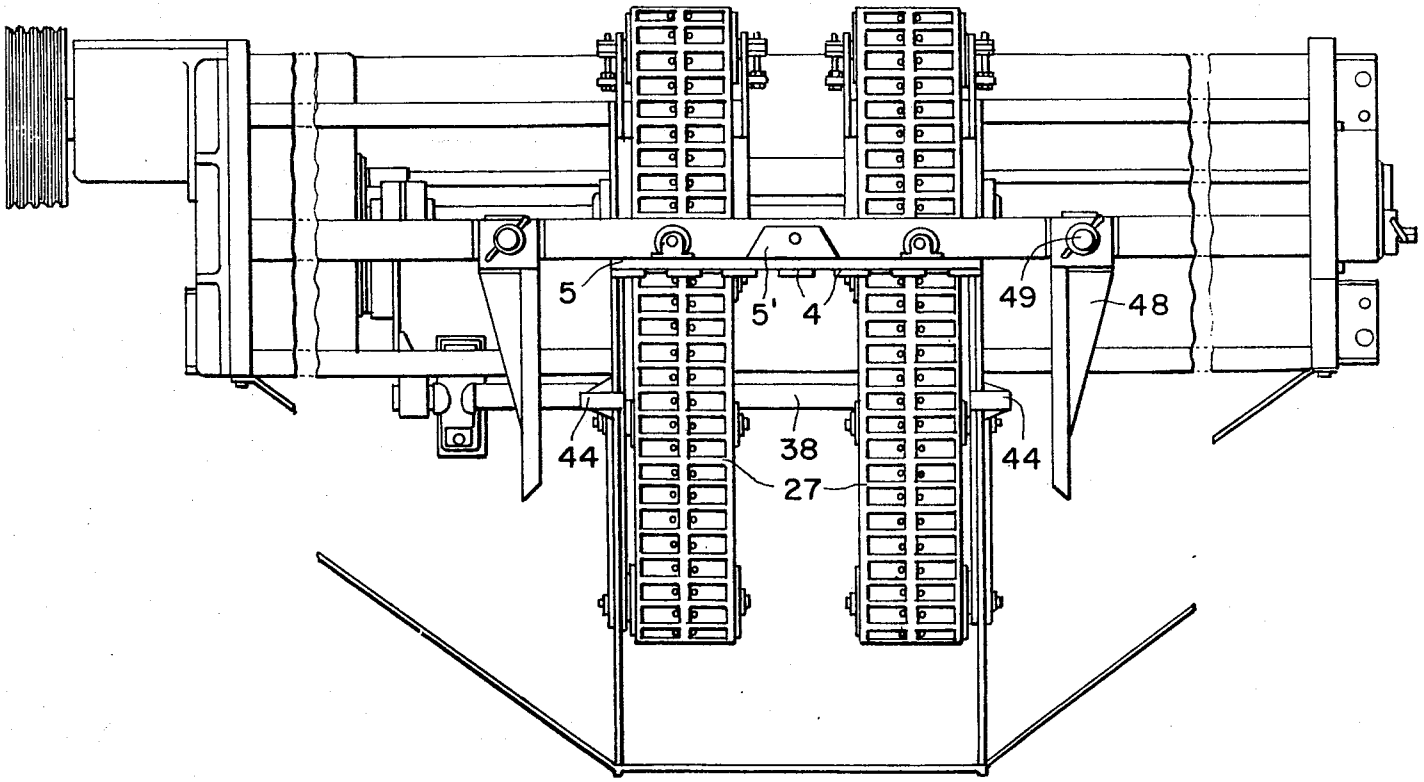
FIG. 3 is a top plan view of the sheet feeding machine.
Figure 4:
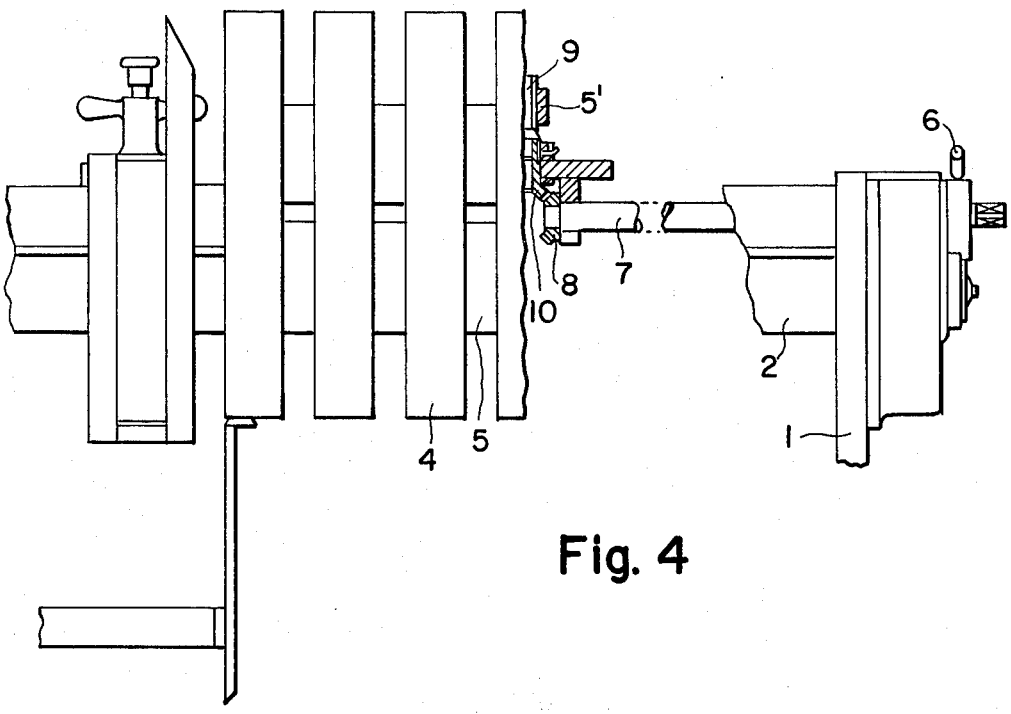
FIG. 4 illustrates a portion of the machine in rear elevation on a larger scale, some elements being broken away to show otherwise concealed elements.
Figure 5:
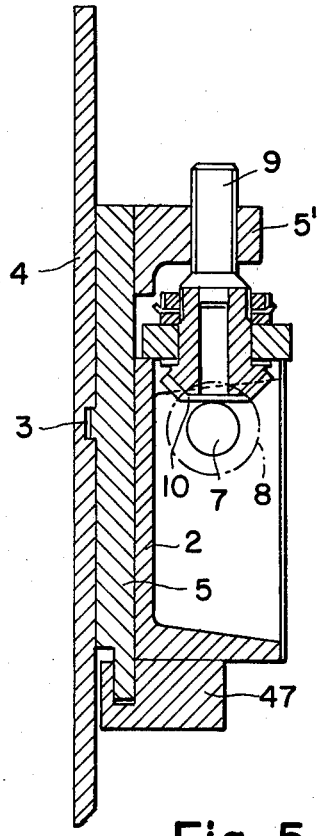
FIG. 5 shows a part of the device of FIG. 4 in side-elevational, enlarged section.

The second suction box 34' is permanently connected with the suction pump by a branch 38' of the hose 38. The belt 27 is duplicated on the other side of the machine, as is evident from FIGS. 2 and 3. The second belt 27 is trained over a set of driven, guide, and tensioning pulleys coaxial with the illustrated pulleys 11 – 15, and over two suction boxes in the manner described with reference to FIG. 1.

As is best understood by joint consideration of FIGS. 1 to 5, two upright frame members 1 extend upward from the casing on opposite sides of the pair of belts 27 and are fixedly connected by a beam 2. Seven upright flat bars 4 are fastened to a common support 5 by a tongue and groove arrangement 3 to form a gate. The lower, reduced edge portion of the support 5 is movably received in a groove of a guide rail 47 on the beam 2. A bracket 5' projects forward from the center of the support 5 and threadedly receives the upright shaft 9 of a bevel gear 10 axially secured on the beam 2. The gear 10 meshes with a gear 8 on a shaft 7 journaled in the frame members 1 and provided with a manually operable crank 6. The gate 4, 5 may be raised and lowered over a small distance by means of the crank 6.

The beam 2 also carries two upright fences 48 parallel to the belts 27 and to each other which may be adjusted manually along the beam 2 and fastened in position by clamping spindles 49, the fences and spindles having been omitted from FIG. 1 for the sake of clarity. The belts 27 thus form the bottom of a receptacle bounded in a forward direction by the smooth faces of the gate bars 4 and laterally by the fences 48. The width of a gap between the bottom ends of the bars 4 and the belts 27 may be adjusted by means of the crank 6.

Figure 6:
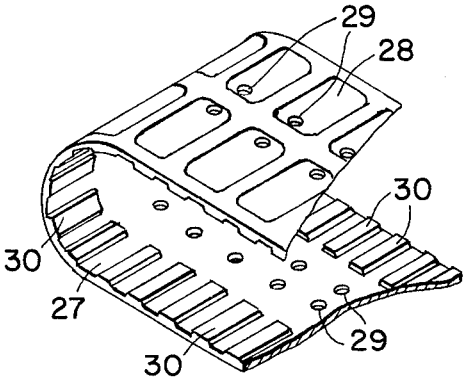
FIGS. 6 to 8 are perspective detail views of elements on the sheet feeding machine.
Figure 7:
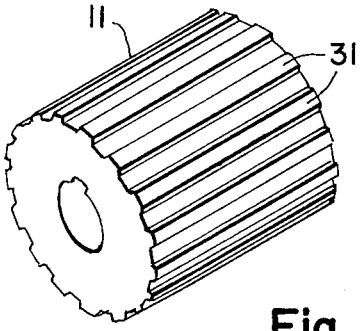

As is seen in FIG. 6, each belt 27 is of unitary molded construction. Its outer face is formed with two rows of shallow, rectangular recesses 28 which occupy approximately one half of the outer belt face. A passage 29 extends from each recess near the longitudinal median line of the belt to the inner belt face which carries two rows of uniformly spaced transverse ribs or cleats 30 on either side of the paired rows of passages 29. As is shown in FIG. 7, the drive pulley 11 carries axial ribs 31 separated by grooves which matingly engage the cleats 30 of the belt 27, and the reversing guide pulleys 13, 15 at the ends of the generally horizontal top strand of the belt 27 are ribbed in the same manner to guide the belt 27 precisely over the suction boxes 34, 34'.

Figure 8:
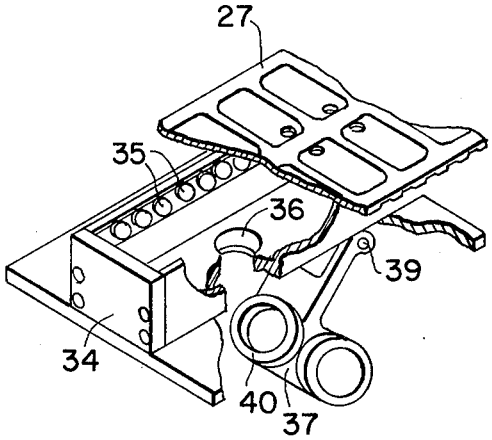

The suction box 34 is shown in detail in FIG. 8. Its open top is elongated in the direction of belt travel, and small rollers 35 adjacent the longitudinal wall of the box cavity engage the smooth part of the inner belt face between the cleats 30 and the passages 29. The passages 29 communicate with the cavity of the box, and the cleats 30 travel outside the box, thereby laterally guiding the belt along the outer faces of the longitudinal box walls. The rollers 35 are precisely positioned to minimize friction between the belt 27 and the top edges of the box walls without permitting much air to leak into the box between the belt and the top edges when a resilient sealing ring 40 on the coupling flap 37 is pressed against the bottom wall of the box 34 by the link 18', thereby coupling the suction hose 38 to a port 36 in the box bottom.

The suction box 34' is identical in structure with the box 34 except for a nippel in the orifice 36 which permanently connects the cavity of the box 34' with the branch hose 38' and the associated, non-illustrated vacuum pump.

Figure 9:
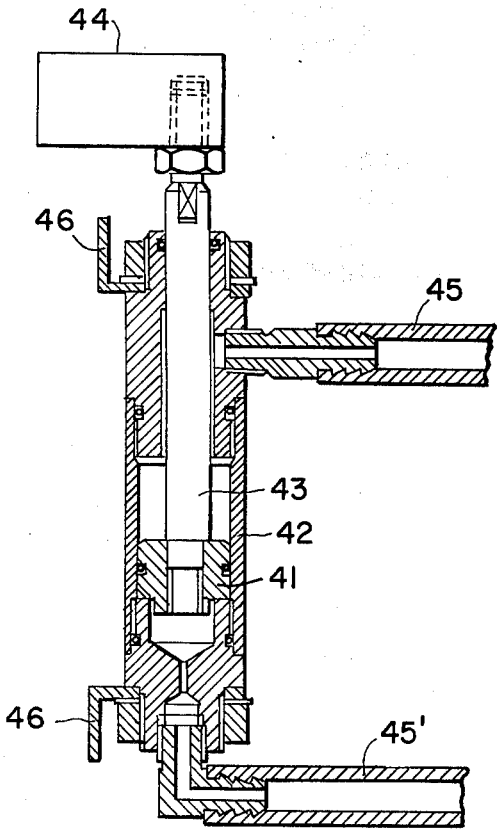
FIG. 9 shows another element of the machine in rear-elevational section on a scale larger than that of FIG. 2.

Two upright pneumatic cylinders 42 are mounted closely adjacent the laterally outer edges of the belts 27 respectively. As is shown in detail in FIG. 9, each cylinder 42 is mounted on the stationary supporting structure of the machine by means of angle irons 46 and encloses a double-acting piston 41. A piston rod 43 extends from the piston 41 out of the upper end of the cylinder 42 and carries a horizontal lifting arm 44 whose top edge is flush with the horizontal upper face of the associated belt 27 near the longitudinal center of the suction box 34. The two compartments of the cylinder 42 axially separated by the piston 41 are alternatively connected to a compressed air line and to the atmosphere by a manually operated reversing valve in a well-known manner, not illustrated.

The apparatus described above has been used to advantage for feeding blanks of corrugated cardboard to box making machinery.

A stack of blanks is placed on the belts 27 in the receptacle between the gate 4, 5 and the fences 48 with the leading edges of the blanks abutting against the bars 4 and the side edges preferably guided by the fences 48. The trailing edges of the blanks need not be aligned vertically, and the blanks superimposed in the stack may alternate in length to some extent if convenient for the box making operation. The gate 4, 5 is raised to only slightly more than the thickness of one blank, and the machine drive is started.

During each revolution of the cam 24, the suction box 34 is coupled once to the suction hose 38 to evacuate the recesses 29 in the portion of the belt 27 traveling over the open top of the box while the strand of the belt 27 is horizontal from the guide pulley 13 to the guide pulley 14. As soon as the front portion of the blank comes within range of the second suction box 34' and is thus pulled through the gap under the gate 4, 5 by the belt 27, the suction box 34 is vented and the pulley 13 is dropped into the position shown in chain-dotted lines. When the next blank drops to the belts 27, the belts slide under the stack without taking the now lowermost blank along, the area of full contact pressure between the belts 27 and the blank being limited in length to the box 34, and there being no vacuum in the box. When the cam 24 again reaches the fully drawn position, the entire length of the lowermost blank rests on the belts 27 under the weight of the entire stack, and the blank is coupled to the belt by the pressure of the ambient air which is not balanced by the low pressure in the recesses 29. After traveling beyond the second suction box 34', each blank is released from the belt 27 for transfer to subsequent conveying and/or processing equipment not itself relevant to this invention.

When it is desired to interrupt the feeding action of the machine without stopping its drive, compressed air is admitted by the non-illustrated manual control valve to the two cylinders 42 through the line 45' while the upper compartment of each cylinder is vented through the line 45. The lifting arms 44 are normally located below opposite edge portions of a sheet carried by the belts 27 over the suction boxes 34. When the piston rods 43 are expelled from the cylinders 42, the sheet is lifted from the belts 27, and ambient air is admitted to the suction boxes 34 through the perforations 29 in the belts 27. Although the coupling flaps 37 may still connect the cavity of each box 34 to the hose 38, the vacuum in the box is broken, and the associated belt 27 slides under the stack of sheets in the receptacle space bounded downward by the belts 27.

An actual embodiment of the sheet feeding apparatus illustrated has been found to deliver a constant stream of corrugated cardboard sheets varying somewhat in their dimensions in the feeding direction and to handle warped and curved sheets without difficulty. No significant difference in operating reliability was found between sheets whose corrugations were parallel to the feeding directions and to sheets having transverse corrugations. No damage whatsoever was caused by the machine to the sheets even when they deviated significantly from proper shape and dimensions and from proper flatness. Very little paper dust entered the suction hose 38 from the flap 37.

While twin belts are preferred for feeding sheets having a width of 18 inches or more in a transverse direction, a machine of the invention having but one perforated belt and trained over a single set of pulleys and suction boxes performs well for smaller blanks. A second suction box, permanently connected to a vacuum pump or other space under a pressure lower than atmospheric pressure, has obvious advantages under some conditions, as outlined above, but it is not needed where sheets discharged from a single suction box enter a chute, and in other arrangements that will readily suggest themselves to those skilled in the art.

It should be understood, therefore, that the foregoing disclosure relates only to a preferred embodiment of the invention, and that it is intended to cover all changes and modifications of the embodiment of the invention chosen herein for the purpose of the disclosure which do not constitute departures from the spirit and scope of the appended claims.

What is claimed is:

1. Sheet feeding apparatus comprising:

a. a support;

b. gate means mounted on said support and bounding a receptacle space in a predetermined direction, said space being adapted to hold a stack of sheets;

c. a continuous, perforated, elongated belt;

d. guide means on said support guiding said belt in a closed, longitudinal loop,

1. said belt in a portion of said loop bounding said receptacle space transversely to said direction for supporting said stack and having a front part adjacent said gate means and a rear part remote from said gate means,

2. said guide means including shifting means for shifting said rear part back and forth between an operative position in which said rear part is aligned with said front part in the direction of elongation of said belt, and an idling position spaced from said operative position outward of said receptacle space, e. drive means for continuously moving said belt in said loop in a direction from said rear part toward said front part;

f. suction means for drawing air from said receptacle space through the perforations of said front part; and g. control means operatively connected to said suction means and to said shifting means for operating the same in timed sequence, said suction means being actuated by said control means when said rear part is in said operative positions, and said perforations in said front part being vented to the atmosphere by said control means when said rear part is in said idling position.

2. Apparatus as set forth in claim 1, wherein said guide means include a plurality of pulleys, said belt being trained over said pulleys, and said suction means include a suction box open toward said front part and formed with a port, one of said guide pulleys being spaced from said suction box in a direction away from said gate means, and said shifting means shifting said one guide pulley inward and outward of said receptacle space.

3. Apparatus as set forth in claim 2, wherein said suction means further include a suction hose and a coupling element connected to said hose, said control means including means for moving said coupling element toward and away from said port and for thereby alternatingly connecting said port to said suction hose and venting said port to the atmosphere.

4. Apparatus as set forth in claim 3, wherein said means for moving said coupling element include a cam member, means for rotating said cam member on said support, and cam follower means interposed between said cam member and said coupling element.

5. Apparatus as set forth in claim 4, further comprising linking means linking said shifting means to said cam follower means.

6. Apparatus as set forth in claim 1, wherein said front part defines a plane extending in said direction, the apparatus further comprising means for moving said gate means toward and away from said plane and for thereby varying the width of a gap between said gate means and said plane.

7. Apparatus as set forth in claim 1, wherein said suction means include a first suction box having a side open toward said receptacle space, and said guide means include a plurality of guide pulleys for guiding said front part over the open side of said suction box, said suction means further including means for alternatingly withdrawing air from said suction box and for venting said suction box to the atmosphere, the apparatus further comprising a second suction box offset from said gate means outward of said receptacle space, said second suction box having an open side aligned with the open side of said first suction box, and engaged by said belt, and means for maintaining a continuous vacuum in said second suction box while air is being withdrawn from said first suction box and while said first suction box is being vented.

8. Apparatus as set forth in claim 1, wherein said suction means include a suction box having a side open toward said receptacle space, and said guide means guiding said front part over the open side of said suction box, said suction means further including coupling means for alternatingly withdrawing air from said suction box and for admitting ambient air to said suction box, while said front part covers said open side, the apparatus further comprising manually operable means for lifting said stack from said front part and for thereby admitting said ambient air to said suction box through the perforations of said front part while air is being withdrawn from said suction box by said coupling means.

* * * * *